United States Patent [19]

Verwey

[11] 4,281,814

[45] Aug. 4, 1981

[54] COVER ASSEMBLY

[75] Inventor: Richard H. Verwey, Pontiac, Mich.

[73] Assignee: Con-Trol Ltd. Inc., Pontiac, Mich.

[21] Appl. No.: 119,306

[22] Filed: Feb. 7, 1980

[51] Int. Cl.[3] ..... A63B 55/04

[52] U.S. Cl. ..... 248/97; 220/331

[58] Field of Search ..... 248/95, 97, 98, 150, 248/164, 166, 188.6; 108/118, 119, 120; 150/17, 48; 232/43.2; 53/390; 141/390; 220/331

[56] References Cited

U.S. PATENT DOCUMENTS

| | | | |
|---|---|---|---|
| 600,764 | 3/1898 | Baily | 248/164 |
| 815,507 | 3/1906 | Bradley | 248/164 |
| 2,338,477 | 1/1944 | Wolters et al. | 220/331 |
| 3,837,608 | 9/1974 | Simon | 248/205 A X |
| 3,893,648 | 7/1975 | Gilbert | 248/150 X |

FOREIGN PATENT DOCUMENTS

| | | | |
|---|---|---|---|
| 546337 | 11/1922 | France | 220/331 |

*Primary Examiner*—J. Franklin Foss

*Attorney, Agent, or Firm*—Gifford, VanOphem, Sheridan & Sprinkle

[57] ABSTRACT

A cover assembly is provided for use with a hamper of a type used in hospitals, nursing homes and for the dirty linen, trash, or the like. The hamper is of a type having a frame with an upper rim over which a removable liner which is positioned and held in an open position. The cover assembly further comprises a pair of elongated mounting brackets secured at one end to the frame at a position spaced downwardly from the upper rim. A planar lid dimensioned to fit over the open end of the liner includes a pair of elongated, spaced and parallel tracks secured to it while a slide block is slidably mounted to each track. Each slide block, in turn, is pivotally mounted to the other end of one of the elongated brackets so that the lid is both pivotally and slidably mounted to the brackets and is movable between an open and a closed position. In its closed position, the lid is positioned over the open end of the liner while, in its open position, the lid lies in a substantially vertical plane adjacent the frame.

6 Claims, 4 Drawing Figures

COVER ASSEMBLY

BACKGROUND OF THE INVENTION

I. Field of the Invention

The present invention relates generally to cover assemblies and, more particularly, to such a cover assembly for use with a hamper.

II. Description of the Prior Art

In hospitals, nursing homes and other types of institutions, dirty linen and trash must be collected on a frequent and periodic basis. Such linen and trash are conventionally collected in one or more hampers throughout the institution. Trash and linen are, of course, collected in separate hampers.

Institutional hampers typically comprise a frame over which a removable liner is positioned and held in place. The removable liner includes an open end and, when positioned over the frame, the open end of the liner faces upwardly. These removable liners, furthermore, are usually constructed of linen which is laundered after each use.

The removable liners employed in the institutional hampers are usually specially manufactured for the hamper frame for simple and rapid placement onto and removal from the hamper frame. To accomplish this, these liners usually include an overlapping portion adjacent their open end which fits around the upper rim on the hamper frame in order to hold the liner to the frame.

It is desirable to provide a cover for institutional hampers for sanitary reasons and there have been a number of previously known hamper covers for this purpose. One type of previously known cover merely comprises a planar lid dimensioned to fit over the open end of the liner when positioned on the hamper frame. The lid is simply lifted and removed from the hamper frame when insertion of dirty linen or trash into the liner is desired. This type of cover, however, is cumbersome and unsatisfactory in use since the lid, when removed, must be positioned on the floor, a chair or some other location so that the person using the hamper must continually stoop down to recover the lid. Moreover, this type of cover rapidly becomes lost since the cover is not attached to the hamper and thus require frequent and expensive replacement.

In still a further type cover assembly for an institutional hamper, a planar lid is pivotally mounted to one or more C-shaped clips so that the planar cover can pivot with respect to the clips. Then, with the removable liner positioned over the upper rim of the hamper frame, the C-shaped clip or clips are attached to the frame rim so that a portion of the liner is sandwiched in between the frame and the C-shaped clips. The lid can then pivot between an open and closed position due to the pivotal connection with the C-shaped clips.

This type of previously known cover assembly, however, has not proven entirely satisfactory in use. One disadvantage of this type of cover assembly is that the lid, when opened, pivots in a relatively wide arc about the frame rim. Because of this, the lid often times bangs into and sometimes damages objects next to the hamper when opened.

A still further disadvantage of this latter type of previously known cover assembly is that the cover must be removed from the hamper frame whenever the liner is positioned onto or removed from the frame since a portion of the liner is entrapped between the C clips and the hamper frame. The frequent removal and subsequent attachment of the cover assembly to the hamper frame is not only cumbersome and time consuming but can also result in accidental damage to the cover assembly and to the C-shaped mounting clips.

SUMMARY OF THE PRESENT INVENTION

The present invention provides an improved cover assembly which is particularly suited for use with an institutional hamper for linen, trash or the like.

The cover assembly of the present invention is designed for use with a conventional institutional hamper of the type having a frame with an upper rim over which a removable liner is positioned and held in place so that an open end of the liner faces upwardly. The frame for such institutional hampers can comprise, for example, a pair of criss crossing U-shaped support legs which are secured together at a mid point along their parallel legs. The free ends of the support legs engage the ground so that the base leg of the U-shaped support legs are spaced and parallel from each other and define the frame rim over which the removable liner is positioned.

The cover assembly itself comprises a pair of elongated mounting brackets wherein one end of one bracket is secured to one of the support legs at a position spaced downwardly from the frame rim. Similarly, one end of the other bracket is secured to the opposite support leg at a position spaced downwardly from the frame rim. Since the attachment between the brackets and the hamper frame is spaced downwardly from the frame rim, the brackets do not interfere with the attachment of the removable liner to the hamper frame.

A planar lid dimensioned to fit over the frame rim, and thus over the open end of a removable liner positioned on the frame, is also provided and has a pair of spaced and parallel tracks secured to it. A slide block is slidably mounted to each track and each block is freely movable from one end of its track and to the other.

The other end of one of the brackets is pivotally secured to one of the slide blocks while, similarly, the other end of the other bracket is pivotally secured to the other slide block. By this arrangement, the lid is both slidably and pivotally secured to the elongated brackets.

In operation, with the lid positioned over the top of the frame rim, and thus over the open top of the removable liner, the slide blocks are positioned at one end of the track. In order to open the lid, the lid is pivoted upwardly and the slide blocks slide down to the other end of the tracks so that the lid is vertically oriented and hangs downwardly from one side of the hamper frame.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
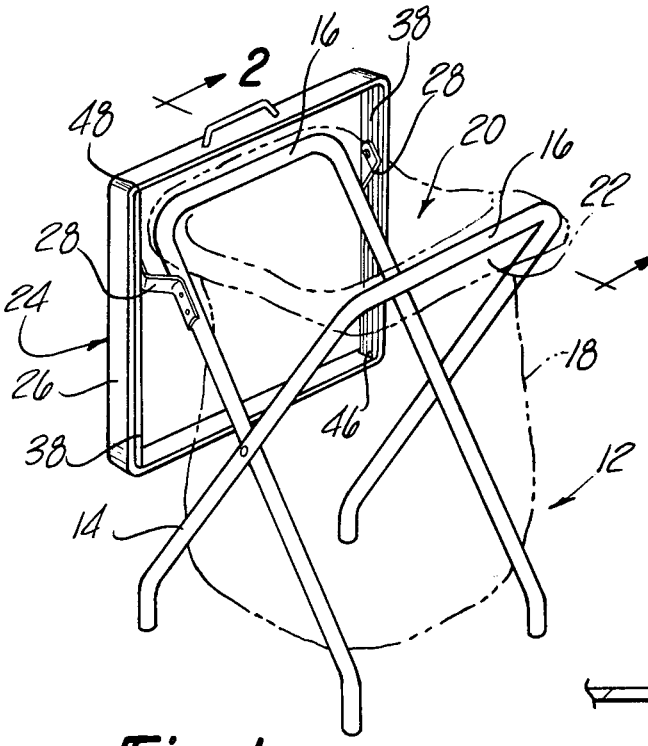
FIG. 1 is a perspective view of a preferred embodiment of the cover assembly of the present invention mounted to a hamper frame.

With reference first to FIG. 1, a preferred embodiment of the cover assembly of the present invention is thereshown mounted to an institutional hamper 12 for linen, trash or the like of the type commonly used in hospitals, nursing homes, and other types of institutions. The hamper 12 is conventional in construction and includes a frame 14 having an upper rim or rim portions 16 over which a removable liner 18 is positioned.

The liner 18 is typically constructed of linen which is laundered after each use but, alternatively, can be constructed of an inexpensive material, such as plastic, so that it can be disposed of after use for sanitary reasons. Moreover, the liner 18 includes an open end 20 and a lip 22 which extends at least partly around the open end 20 of the liner 18. The liner 18 is usually manufactured to fit a particular hamper frame 14 so that with the liner 18 positioned over the top of the frame 14, the rim portions 16 are positioned in between the liner lip 22 and the main body of the liner 18. The liner lip 22 thus not only holds the liner 18 to the frame 14 but also maintains the end 20 of the liner 18 open and facing upwardly. The lip 22 of the liner 18, of course, extends downwardly from the frame rim portions 16 for a small distance.

Figure 2:
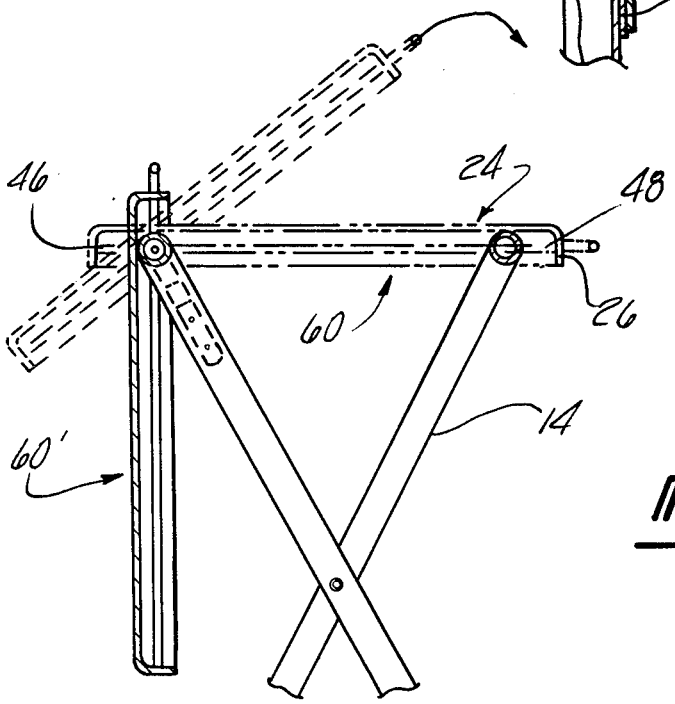
FIG. 2 is a fragmentary side view illustrating the operation of the cover assembly and taken substantially along line 2—2 in FIG. 1.

With reference now to FIGS. 1 and 2, the cover assembly of the present invention further comprises a planar lid 24 having a downwardly extending lip 26 extending around its outer periphery. The lid 24 is dimensioned so that it can fit over the rim portions 16 of the hamper frame 14 (FIG. 2) and, in doing so, cover the open end 20 of the liner 18 contained thereon. Moreover, although the lid 24 is illustrated as rectangular in shape in the drawing, it will be understood that this is by way of example only. In practice the lid 24 can be rectangular, round, triangular in shape among others.

Figure 3:
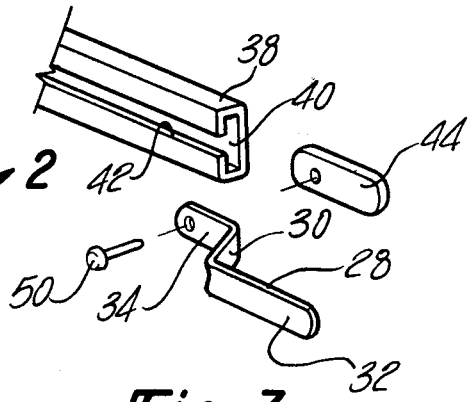
FIG. 3 is a fragmentary exploded view illustrating a part of the ocver assembly.
Figure 4:
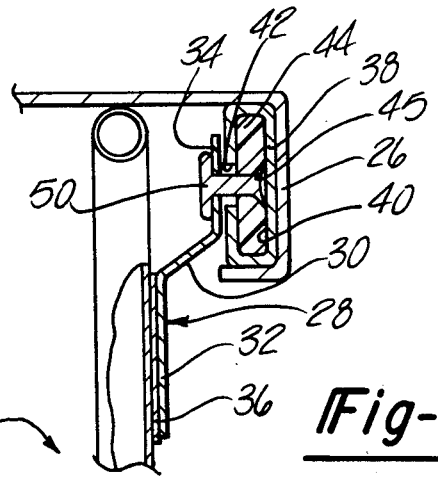
FIG. 4 is a fragmentary sectional view illustrating a part of the cover assembly.

Referring now to FIGS. 1, 3 and 4, in order to mount the lid 24 to the frame 14, a pair of elongated brackets 28 are provided and each bracket 28 has an outwardly flared portion 30 thus forming a lower leg 32 at one end of the bracket 28 and an upper leg 34 at the opposite end of the bracket 28. The lower legs 32 of the brackets 28 are secured to the hamper frame 14 at a position spaced downwardly from the frame rim portion 16 so that the brackets 28 are spaced and generally parallel to each other. The flared portions 30 of the brackets 28, however, face away from each other and thus away from the hamper frame 14. With the brackets 28 secured to the frame 14 the upper bracket legs 34 protrude upwardly and adjacent one rim portion 16 of the frame 14 for a reason to be subsequently described. In addition, the lower bracket leg 32 is spaced downwardly from the rim portion 16 by an amount sufficient so that the removable liner 18 can be positioned onto the hamper frame 14 without interference from the brackets 28.

As best shown in FIG. 4, although any conventional means can be used to secure the brackets 28 to the hamper frame 14, preferably a strip 36 having adhesive on both sides is positioned between each mounting bracket 28 and the hamper frame 14, thus the mounting brackets 28 can be simply pressed against the hamper frame 14 and are thereafter held in place by the adhesive strip 36.

Referring now particularly to FIGS. 1, 3 and 4 an elongated track 38 is secured to the lip 26 of the lid 24 along opposite sides of the lid 24 so that the tracks 38 are generally spaced and parallel with respect to each other. Each track 38, moreover, is C-shaped in cross section, and as shown in FIGS. 3 and 4, defines an interior 40 which is open through an elongated slot 42 in each track 38. The tracks 38 are secured to the lid 24 so that the slots 42 face each other.

With reference now to FIGS. 3 and 4, a block 44 is slidably positioned within the interior 40 of each track 38. Each block 44 is capable of sliding from one end 46 of each track 38 and to the other end 48 of each track 38 (FIGS. 1 and 2).

Each block 44 is rotatably mounted to the upper leg 34 of one of the mounting brackets 28 by a pin 50. Each pin 50 is secured in place by any conventional means, such as a flared portion 45 (FIG. 4).

The operation of the cover assembly of the present invention is as follows:

With reference to FIG. 2, the lid 24 is thereshown at 60 positioned over the hamper rim portions 16 so that the lid 24 covers the open upper end of the liner (not shown). At this time, the slide block 44 are positioned adjacent the ends 46 of the tracks 38.

When it is desired to open the cover assembly, the planar member 24 is simply tilted upwardly, as shown in phantom line, which is possible due to the rotational connection between the mounting brackets 28 and the slide blocks 44. When the lid 24 is substantially in a vertical plane, the lid 24 is either released or lowered until the lid 24 reaches the position shown at 60' in which the lid 24 lies in substantially a vertical plane and closely adjacent the hamper frame 14. Moreover, with the planar member 24 in its lower position, the slide blocks 44 have moved to the opposite ends 48 of tracks 38.

When it is again desired to cover the open top 20 of the liner 18, the lid 24 is simply lifted upwardly from its lower position, thus moving the slide blocks 44 to the ends 46 of the tracks 38, and the lid 24 thereafter is rotated or pivoted over and onto the top of a hamper rim portion 16.

From the foregoing, it can be seen that the cover assembly according to the present invention is advantageous in a number of different respects. First, even though the cover assembly is permanently mounted to the hamper, the removable liners 18 can be removed from and replaced onto the hamper frame 14 without disconnecting the cover assembly from the frame 14. Thus, the previously known loss of the covers for the previously known institutional hampers is entirely eliminated.

A still further advantage of the cover assembly of the present invention is that the cover assembly does not pivot outwardly in a wide arc from the hamper frame 14. Rather, once the 24 has been rotated to a vertical position, further rotation of the lid 24 is not required but instead the lid 24 is merely lowered into a vertical position closely adjacent the hamper frame 14.

Having described my invention, however, many modifications thereto will become apparent to those skilled in the art to which it pertains without deviation from the spirit of the invention as defined by the scope of the appended claims.

I claim:

1. A cover assembly for a hamper, said open at one end, said liner being insertable over said frame rim, said cover assembly further comprising:

a pair of elongated mounting brackets, means for securing one end of each bracket to the frame at a position spaced downwardly from the frame rim, a substantially planar lid, a pair of elongated spaced and parallel tracks secured to said lid, a block rotatably secured to the other end of each bracket, each block being slidably mounted to one of said tracks and movable between a first position and a second position, wherein in said first position said lid extends over and covers the open end of the liner and wherein in said second position said lid is spaced from and exposing the open end of the liner, and wherein each bracket further comprises a pair of substantially parallel and spaced apart legs and a flared portion extending between and connecting said legs, one leg of each bracket being rigidly secured to said frame so that said flared portion is spaced downwardly from the top of the frame rim and so that the other bracket leg extends above said flared portion whereby a lip of the liner can be positioned around the outer periphery of said frame rim between said rim and said other bracket legs.

2. The invention as defined in claim 1 wherein said second position, said lid lies in substantially a vertical plane and depends downwardly from adjacent the frame rim.

3. The invention as defined in claim 1 wherein said securing means further comprises a pair of strips each strip having adhesive on both sides, and one of said strips being disposed between each bracket and the frame.

4. The invention as defined in claim 1 wherein said lid is rectangular in shape and wherein said tracks extend substantially entirely along opposite sides of the lid.

5. The invention as defined in claim 1 wherein each track is C-shaped in cross section thus defining an interior and wherein said slide blocks are slidably mounted with the interior of their respective tracks.

6. The invention as defined in claim 4 wherein said lid includes a lip formed about its periphery and wherein said tracks are secured to facing portions of the lip.

* * * * *